US006673992B1

(12) United States Patent
Runyon

(10) Patent No.: US 6,673,992 B1
(45) Date of Patent: Jan. 6, 2004

(54) SAXOPHONE MOUTHPIECE

(76) Inventor: Clinton A. Runyon, 174 Emerite Dr., Lafayette, LA (US) 70506

( * ) Notice: Subject to any disclaimer, the term of this patent is extended or adjusted under 35 U.S.C. 154(b) by 240 days.

(21) Appl. No.: 09/666,748

(22) Filed: Sep. 20, 2000

(51) Int. Cl.[7] ..... G10D 9/02

(52) U.S. Cl. ..... 84/383 A; 84/383 R

(58) Field of Search ..... 84/383 R, 383 A, 84/380 R, 385 A

(56) References Cited

U.S. PATENT DOCUMENTS

| | | | | |
|---|---|---|---|---|
| 1,583,382 A | | 5/1926 | Bauer | |
| 2,224,719 A | | 12/1940 | Brilhart | |
| 2,397,593 A | | 4/1946 | Brilhart | |
| 2,499,855 A | | 3/1950 | Gamble | |
| 2,530,155 A | | 11/1950 | DeLuca | |
| 3,202,032 A | | 8/1965 | Strarhmann | |
| 4,041,827 A | | 8/1977 | Daglis | |
| 4,212,223 A | | 7/1980 | Runyon | |
| 4,345,503 A | * | 8/1982 | Runyon | 84/383 R |
| 5,542,331 A | * | 8/1996 | Hartmann et al. | 84/383 A |

* cited by examiner

*Primary Examiner*—Kimberly Lockett
(74) *Attorney, Agent, or Firm*—Robert N. Montgomery

(57) ABSTRACT

The present invention, is a new design for a woodwind musical instrument mouthpiece capable of harmonic vibration. The mouthpiece is fitted with an interchangeable tone-altering member including an interchangeable secondary reed having a wave form which vibrates inside the tone chamber of the vibratable mouthpiece for the purpose of adding intensity and character to the tone quality when the mouthpiece is played with an associated appropriate musical instrument the secondary reed includes on one end thereof a wedge-shaped member which alters the size of the tone chamber and, thereby, further changes the tone produced by the instrument. The interchangeable, tone-altering element is preferably mounted within the interior of the tone chamber such that the secondary reed is positioned in a plane substantially on the longitudinal axis of the tone chamber and is positioned on the side of the secondary reed facing the primary reed and at the end nearest the opening of the mouthpiece tapering in the direction of the opening of the mouthpiece. The combined tone-altering member is positioned within the interior of the tone chamber and retained therein by friction alone against opposite sides of the tone chamber. Varying the sizes and shapes of the wedge, the interchanging of the combined tone-altering element combined with the harmonic vibration of the mouthpiece induces a wave form which intensifies the tone or sound of the instrument and allows the individual artist to produce the varying volume and types of sound that may be produced.

16 Claims, 3 Drawing Sheets

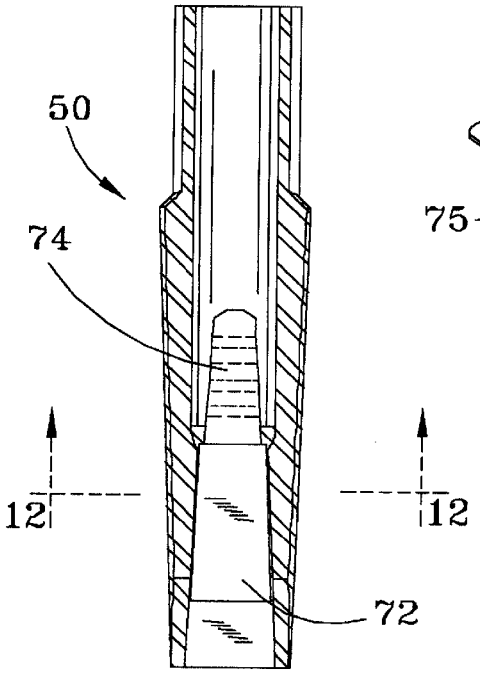
FIG. 11
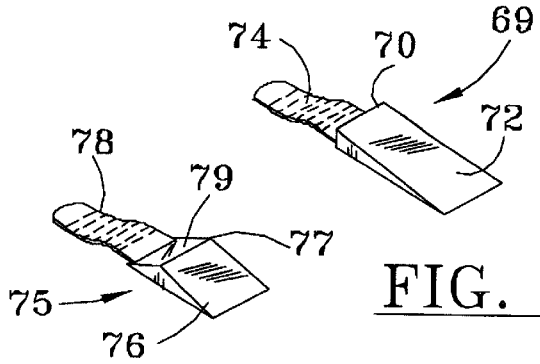
FIG. 9
FIG. 10
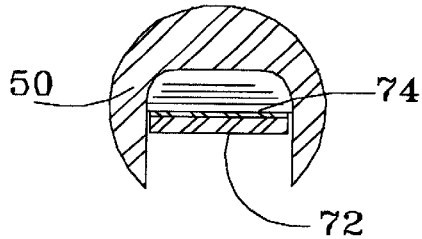
FIG. 12
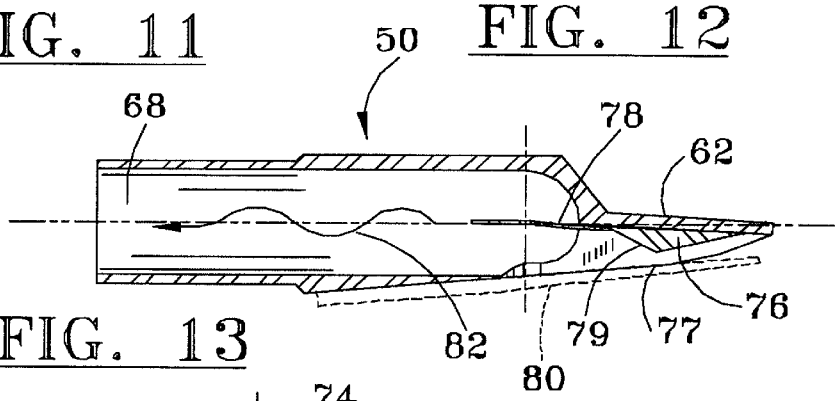
FIG. 13
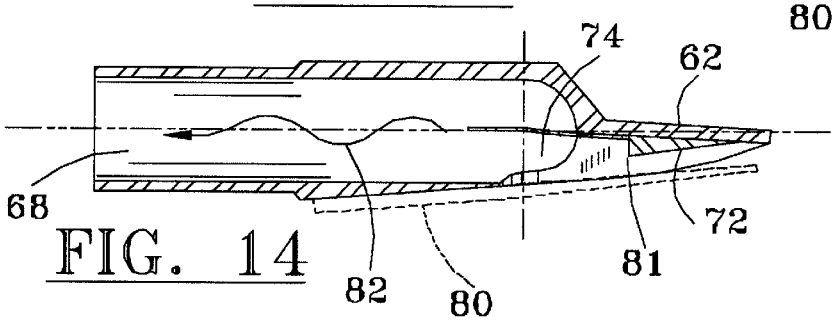
FIG. 14

SAXOPHONE MOUTHPIECE

BACKGROUND OF THE INVENTION

1. Field of the Invention

This invention relates generally to wind instrument mouthpieces and more particularly to clarinet and saxophone harmonic mouthpieces with sympathetic reeds. More specifically, the invention contemplates a modification of the mouthpiece for single reed instruments, such as clarinets and saxophones, wherein an improved independent and interchangeable secondary reed, having mounted thereon a wedge, is positioned inside the hollow mouthpiece chamber, the secondary reed vibrating sympathetically when the primary reed is placed in vibrating motion during ordinary use of the instrument to which the mouthpiece is attached and the wedge altering the cross-sectional area of the tone chamber of the mouthpiece, and whereby the mouthpiece vibrates in harmonic resonance with both the primary and sympathetic reeds.

2. General Background

Interchangeable, wedge-shaped members have been positioned within the interior of mouthpiece chambers of woodwind instruments in order to change the cross-sectional area of the chamber and, thereby, modify the tone quality that is produced. Such structures are shown in U.S. Pat. Nos. 2,397,593 issued Apr. 2, 1946, to Brilhart; U.S. Pat. No. 3,202,032, issued Aug. 24, 1965, to Strathmann, and U.S. Pat. No. 2,530,155, issued Nov. 14, 1950, to DeLuca. U.S. Pat. No. 4,041,827, issued Aug. 16, 1977, to Daglis, discloses a tone-enhancing element that is incorporated within the mouthpiece of a reed instrument, the element having two steps projecting into the air flow-through passage of the mouthpiece at a point opposite the opening over which the reed is mounted. U.S. Pat. Nos. 2,224,719, issued Dec. 10, 1940, to Brilhart and U.S. Pat. No. 2,499,855, issued Mar. 7, 1950, to Gamble, disclose adjusting the tone quality of woodwind instruments by including means which contact the primary reed in order to alter the tone quality produced by the instrument. Another mouthpiece is disclosed in U.S. Pat. No. 1,583,382, issued May 4, 1926, to Bauer, wherein a single piece of stamped, bifurcated metal is secured to the inside surface of the mouthpiece, where functioning depends on a critical position in the mouthpiece of the inserted piece of metal in order to accomplish tone alteration. In U.S. Pat. No. 4,212,223, issued Jul. 15, 1980, to the present inventor, a mouthpiece for a woodwind musical instrument is disclosed which contains a primary reed and a secondary reed positioned within the interior of the mouthpiece and which is positioned substantially parallel to the primary reed. While the inventor's prior patent has proven successful in altering the tonal quality of reed instruments, the present invention provides a more easily interchangeable member adaptable to both conventional and specifically adapted mouthpieces, which combines a secondary reed with a wedge-shaped member placed thereon to alter the tone quality of the reed instrument. The secondary reed in the present invention has a wave configuration in combination with very specific shapes for the wedge. Further, the mouthpiece itself is designed to vibrate in harmonic combination with the primary and secondary reeds. None of the other mentioned patents contains a disclosure of a secondary reed suspended in the instrument mouthpiece tone chamber substantially parallel or offset to the primary reed, nor do any of the patents disclose the interchangeable, tone-altering member of the present invention, which includes a combination of a sympathetically vibrating secondary reed and a wedge-shaped member placed thereon, which alters the cross-sectional area of the tone chamber or a vibrating mouth piece.

SUMMARY OF THE INVENTION

In accordance with the present invention, a new design for a woodwind musical instrument mouthpiece is provided capable of harmonic vibration. The mouthpiece fitted in the interior thereof with an interchangeable tone-altering member comprising an interchangeable secondary reed having a wave form which vibrates inside the tone chamber of the mouthpiece for the purpose of adding intensity and character to the tone quality when the mouthpiece is played with an associated appropriate musical instrument and which includes on one end thereof a wedge-shaped member which alters the size of the tone chamber and, thereby, further changes the tone produced by the instrument. The instruments which are particularly contemplated for modification according to the teachings of the present invention include but are not limited to various types of clarinets and saxophones, such as a B-flat clarinet, an alto clarinet, a bass clarinet, and the like; also contemplated are alto saxophones, tenor saxophones, baritone saxophones, soprano saxophones, bass saxophones, and the like. The interchangeable, tone-altering element is preferably mounted within the interior of the tone chamber such that the secondary reed is positioned in a plane substantially parallel to the plane of the longitudinal extent of the tone chamber. The wedge-shaped member is positioned on the flat side of the secondary reed facing the primary reed and is positioned on the secondary reed at the end nearest the opening of the mouthpiece. The wedge-shaped member tapers in the direction of the opening of the mouthpiece. The combined tone-altering member is positioned within the interior of the tone chamber and retained therein by friction alone on opposite sides of the tone chamber. By varying the sizes and shapes of the wedge, the interchanging of the combined tone-altering element will thus modify the tone or sound of the instrument and allow the individual artist to produce the varying types of sound that may be required. Accordingly, it is an object of the invention to provide a vibrating mouth piece in accordance with the Boehm theorem, which stipulates that in order to achieve a brilliant and sonorous quality from a wind instrument it is necessary that the molecules of the instrument be set in motion simultaneously with vibration of the air column in a manner so that they assist each other.

It is another object of the present invention to provide a mouthpiece for reed instruments wherein the mouthpiece is provided with an interchangeable, tone-altering member mounted within a wind instrument mouthpiece for altering the tone produced by the instrument. Another object of the invention is to provide an interchangeable tone-altering member which can be positioned within the interior of the mouthpiece of a wind instrument, the tone-altering member comprising a secondary reed which vibrates sympathetically within the tone chamber of the musical instrument mouthpiece and a wedge positioned on one end of the secondary reed for altering the cross-sectional area of the tone chamber. Still another object of the invention is to provide a mouthpiece for a wind instrument with an interchangeable, tone-altering member formed of a secondary reed which vibrates sympathetically with the primary reed of the instrument and which further includes a wedge positioned on one end of the secondary reed for altering the cross-sectional area of the tone chamber, the interchangeable member being positioned into and out of the interior of the tone chamber by friction, the wedge portion in contact with the side walls of the mouthpiece.

Yet another object of the invention is to alter the tone quality of a reed instrument by incorporating within the interior of the tone chamber of the instrument an interchangeable, tone-altering member which comprises a secondary reed having a wave shape which vibrates sympathetically with the primary reed and a wedge-shaped member having numbered configuration designations positioned at one end of the secondary reed and which alters the cross-sectional area of the tone chamber in a very precise manner. These, together with other objects and advantages which will become subsequently apparent, reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 9 is an isometric view of a first embodiment of the secondary reed;

FIG. 10 is an isometric view of a second embodiment of the secondary reed;

FIG. 11 is a cross section view taken along sight line 11—11 seen in FIG. 7;

FIG. 12 is a cross section view taken along sight line 12—12 seen in FIG. 11;

FIG. 13 is a cross section view taken along sight line 8—8 in FIG. 6 with the reed shown in FIG. 10 in place; and FIG. 14 is also a cross section view taken along sight line 8—8 in FIG. 6 with the reed shown in FIG. 9 in place.

DETAILED DESCRIPTION OF THE PREFERRED EMBODIMENT

Figure 1:
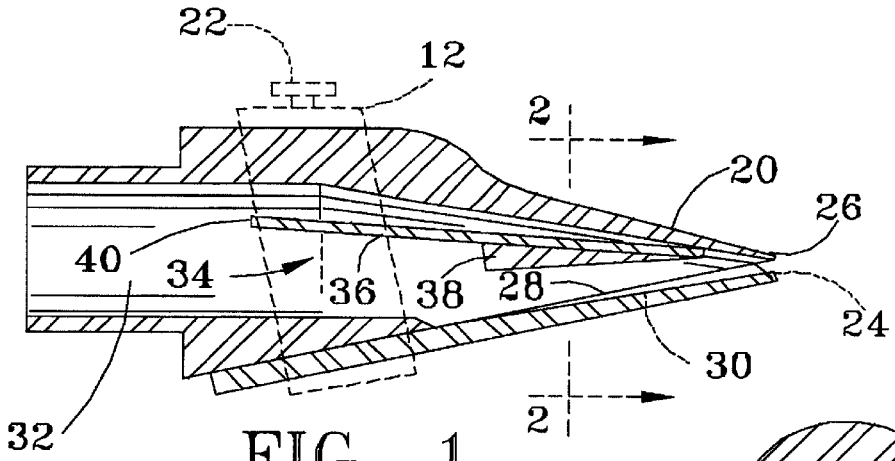
FIG. 1 Prior Art
FIG. 1 is a cross-section view of applicant's previous invention for a secondary reed with tone enhancing member with typical mouthpiece.
Figure 2:
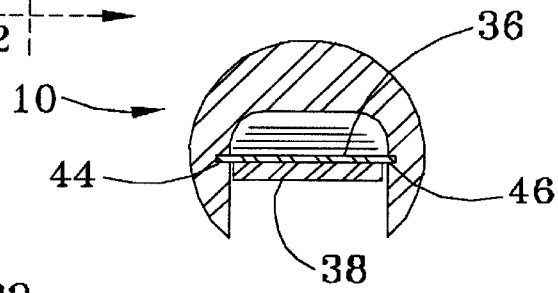
FIG. 2 Prior Art
FIG. 2 is a cross-section view taken along sight line 2—2 as shown in FIG. 1.
Figure 3:
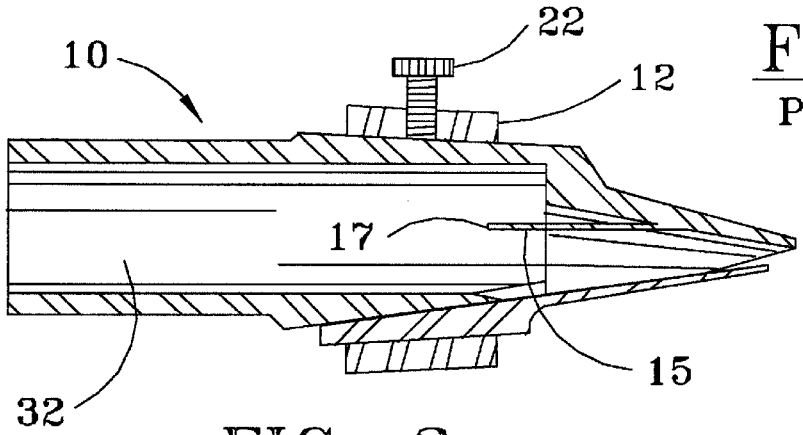
FIG. 3 Prior Art
FIG. 3 is a cross-section view of another of applicant's previous inventions for a secondary reed with typical mouthpiece.
Figure 4:
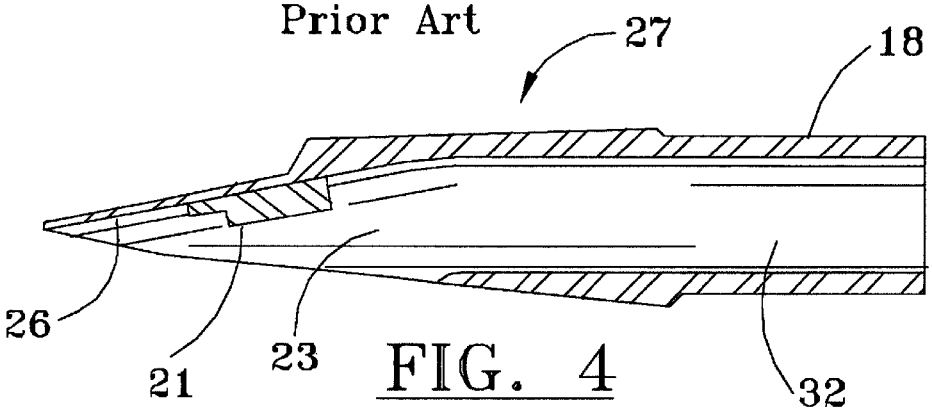
FIG. 4 Prior Art
FIG. 4 is a cross-section view of the prior art with tone enhancing member and non-typical mouthpiece.

The mouthpiece for single reed instruments is conventionally carved from wood or plastic, or, if made from plastic, can be made by conventional lost wax casting or injection molding techniques. Although varying somewhat in size, external appearance, and shape, according to the intended instruments with which the mouthpiece is to be used, the general configuration and structure of mouthpiece to be used with various single reed musical instruments is shown in FIGS. 1 and 2, wherein a mouthpiece 10 is illustrated, over which a tapered annular ligature 12 slides in order to retain primary reed 14 in contact with the lower surface 16 of mouthpiece 10. Mouthpiece 10 is made up of a tubular connection portion 18 for insertion within the upper end of a conventional wind instrument body (not shown), and mouthpiece 10 also has an upper inclined wall 20 against which the musical performer's upper lip rests during operation of the instrument. Thumbscrew 22 passes through an orifice in ligature 12, with rotation of thumbscrew 22 effecting tightening action of ligature 12 against the lower surface 16 of mouthpiece frame 10 to hold primary reed 14 in place. The construction and operation of ligature 12 is standard and conventional and does not relate to the operation or mounting of the tone-altering member of the present invention. Primary reed 14 can be seen held in place against lower surface 16 of mouthpiece 10 by ligature 12. Primary reed 14 is conventionally cut out of elastic reed plates, such as cane, and tapers to primary reed edge 24, which projects somewhat below arcuate end 26 of inclined wall 20 of mouthpiece 10, leaving a chink through which the musician blows in order to set tapered edge 24 in vibratory motion in conventional operation of the instrument. Vibrations of primary reed 14 set the entire column of air within the instrument in motion and reinforcement from waves of air that arise in the interior of the instrument produces an alternation in the pressure of air adjacent to reed 14 sufficiently powerful to make it vibrate sensibly. The tones produced by instrument has a pitch determined by the length of the column of air in the instrument, the acoustic length of which can be altered by opening the side holes located in the body (not shown) of the instrument. The time of vibration of primary reed 14 consists of the time of forward motion, the time of rest, and the time of recoil. When the reed is placed in the player's mouth, the air pressure on inside surface 28 of reed 14 is equal to the pressure against outside surface 30 of reed 14. As the musician blows air through the chink between surface 26 and reed 24, a suction is created against inside surface 28, drawing edge 24 in the direction of end 26 after the pulse of compressed air exits at the first found point of outlet on the musical instrument. External air then rushes in to restore equilibrium and cause edge 24 of reed 14 to recoil. Cyclic repetition of this process sets the entire column of air within mouthpiece frame 10 and the associated instrument body (not shown) in periodic motion, which generates the acoustic tone or sound characteristic of the musical instrument. Accordingly, the air within mouthpiece tone chamber 32 oscillates to form a wave characteristic of the musical instrument with its side holes opened as desired by the musician to generate the desired tone. Positioned within tone chamber 32 are the tone-altering member 34 of the present invention comprising secondary reed 36 and wedge 38. The oscillatory motion of the air within tone chamber 32 sets secondary reed 36 into sympathetic vibration and causes a modification in the tone quality obtained. Similarly, the thickness and configuration of wedge 38 alters the cross-sectional area of tone chamber 32 and, thus, the column of air which is set in motion in tone chamber 32 and, thereby, further modifies the tone quality obtained from the musical instrument. The phenomenon of sympathetic resonance is well known to musicians. When, for example, the strings of two violins are tuned to the same pitch, and one string is bowed, the other will begin to vibrate. Even when the pitch of the primary sounding body is not exactly that of the sympathetically vibrating body, the latter will, nevertheless, often make sensible sympathetic vibrations which diminish in amplitude as the difference of pitch increases. Light elastic bodies, which offer little resistance, can be more easily adapted to vibrate sympathetically to a primary tone than massive elastic bodies. Moreover, sympathetic vibration can also be induced, corresponding to the harmonic upper partial tones of the primary body. The mode of transmission from a primary vibrating body to a secondary vibrating body is well known in the theory of sound, involving principles of wave motion observable in response to periodic changes in air pressure created by mechanical motion. Accordingly, when primary reed 14 begins to vibrate by movement of edge 24 alternately toward and away from end 26 of mouthpiece 10, thereby setting in oscillatory motion the air in tone chamber 32 and producing the characteristic combination of proper and harmonic tones which are unique to the particular instrument with which the mouthpiece is associated, sympathetic reed 36 begins to vibrate through the action of the oscillatory motion of the air within tone chamber 32, with end 40 of secondary reed 36 describing vibratory motion in a direction essentially perpendicular to its plane. The addition of a sympathetic reed within the tone chamber of the mouthpiece of a wind instrument is disclosed in U.S. Pat. No. 4,212,223 issued to the present inventor, as illustrated in FIG. 3. The secondary or sympathetic reed 15 was either molded as a part of the mouthpiece 10 or adhered to the upper wall of mouthpiece 10 with tip 17 extending into the tone chamber 32. By incorporating a fixed secondary reed structurally within the tone chamber of the mouthpiece, it was found that the tone quality of the instrument is altered and that greater intensity and character of the tone quality results with less exertion by the player. Aesthetically speaking, use of the invention adds another dimension and life to the tone. With the use of a secondary reed 15, not only is the quality of the musical experience enhanced, but the musician is capable of achieving a wider variety of artistic effects with less effort, in somewhat the same manner as a musician playing a trumpet or trombone with an added mute or a musician playing a violin or viola when modifying the tone quality with an appropriate muting device. Unlike the various known muting devices, however, a secondary reed does not shade the tone quality toward a more subdued or mellow character, but, instead, achieves the opposite tone modification by adding extra intensity, character, and life without detracting therefrom. The addition of the wedge 38, as seen in FIG. 1 and fully disclosed in applicant's U.S. Pat. No. 4,345,503, was a significant improvement on the earlier, patented secondary reed, which took advantage of the technology taught by Daglis in U.S. Pat, No. 4,041,827 as illustrated in FIG. 4

Wherein a step block 21 was used to reduce the area between the tip 26 and the primary reed opening 23 of a more streamlined mouthpiece 27, thereby reducing the area of the tone chamber entrance and thus increasing velocity of air passing through the mouthpiece 27, as seen in FIG. 1, the wedge 38 combined with the secondary reed 36 effectively reduces the area of the opening between the primary reed and the upper wall 20. Therefore tone-altering member 34 comprises secondary reed 36 and wedge 38, which is built on one end of secondary reed 36 and which is also placed within tone chamber 32. Wedge 38 alters the tone chamber so that it comprises a smaller cross-sectional area and thereby changes the tone quality of the instrument to a thinner, more piercing type of tone and further increases the volume. The thicker the wedge 38, the louder the tone emanating from the musical instrument will be. As can be seen, wedge 38 is placed on secondary reed 36 so as to face and lie in a plane substantially parallel to primary reed 14. The wedge tapers in a direction from the interior of tone chamber 32 toward end 26 of surface 20. It has been found that the configuration of the wedge 38 further enhances the tone quality and amplitude, as will be discussed further herein. Tone-altering member 34 can be constructed of the same material as mouthpiece frame 10. Secondary reed 36 and wedge 38 can be made as an integral unit or the two members can be formed separately and bonded together by either a separate bonding agent or fused together if formed from plastic. Accordingly, tone-altering member 34 can be made of metal, wood, cane, or plastic.

Although the secondary reed or tone altering member 34 has been described and illustrated with respect to modification of a single reed mouthpiece, such as that in use with saxophones and clarinets of various types, the concept of the sympathetic or secondary reed can be extended to modify tone quality of double reed instruments, such as the oboe, bassoon and English horn. Materials of construction for mouthpiece 10 can vary, including the plastic illustrated in the drawings, but also encompassing metal, hard rubber, and the like. Moreover, primary reed 14 can be selected from a plurality of possible construction materials, including plastic, elastic wood, French cane, and the like. An important feature of the prior art relates to the interchangeability of secondary reed or tone-altering member 34. Accordingly, various sizes and types of secondary reeds 36 can be associated with wedges 38 of various thicknesses so as to allow the musician to change the tone quality of the instrument by simply interchanging the various tone-altering members 34. Referring to FIG. 2, it can be seen that previously tone-altering member 34 was provided with a pair of mounting flanges 44 and 46 which are formed on opposite sides of reed 36 at the end which supports wedge 38. Flanges 41 and 42 fit within a pair of longitudinal retaining grooves formed in the interior of mouthpiece 10. Accordingly, previously to remove one particular tone-altering member 34 and replace it with another having a different shape, size or configuration, one had to remove the primary reed and insert a pointed object at the inner end of wedge 38 and slide tone-altering member 34 outwards so that it no longer was retained within the grooves. It can be seen that the secondary reed 34 could only be installed on mouthpieces that have receptive grooves. This is a serious disadvantage if a musician desires to use the secondary reed with other mouthpieces.

Figure 6:
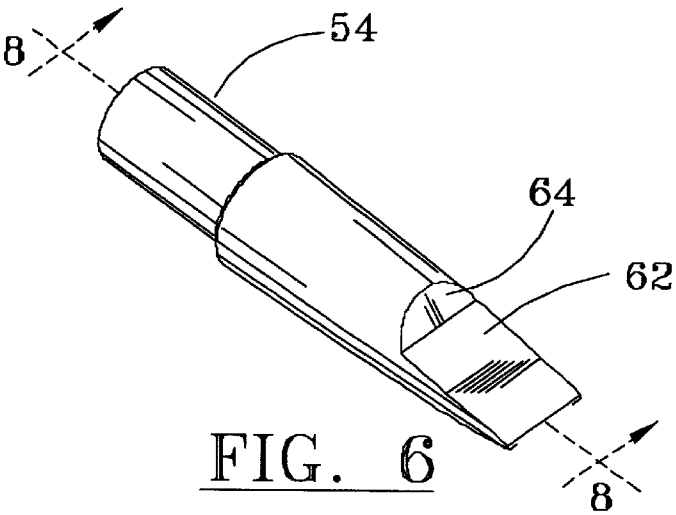
FIG. 6 is an isometric view of the preferred embodiment of applicant's new mouthpiece.
Figure 5:
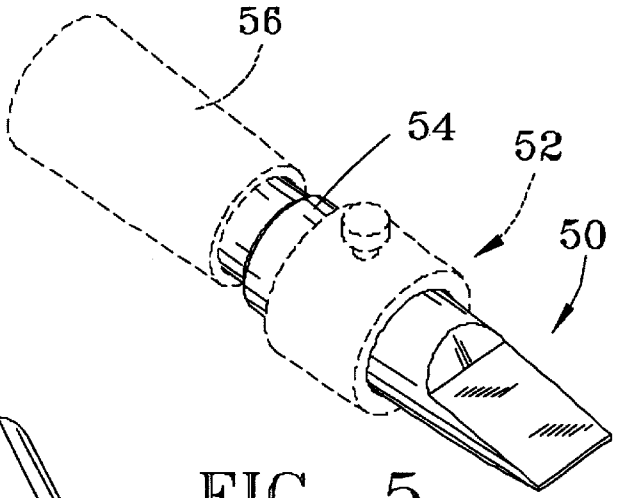
FIG. 5 is an isometric assembly view of the preferred embodiment of applicant's new mouthpiece.
Figure 8:
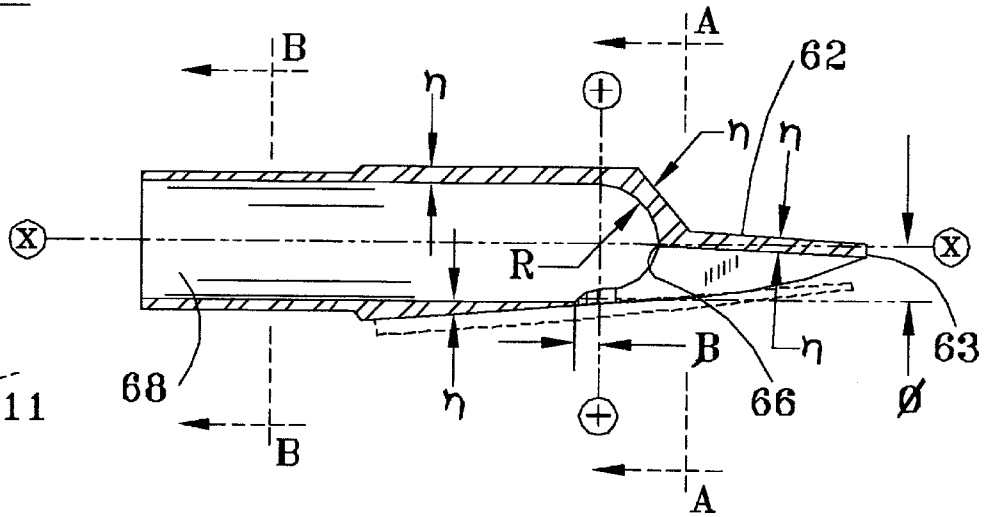
FIG. 8 is cross-section view taken along sight line 8—8 in FIG. 6.
Figure 7:
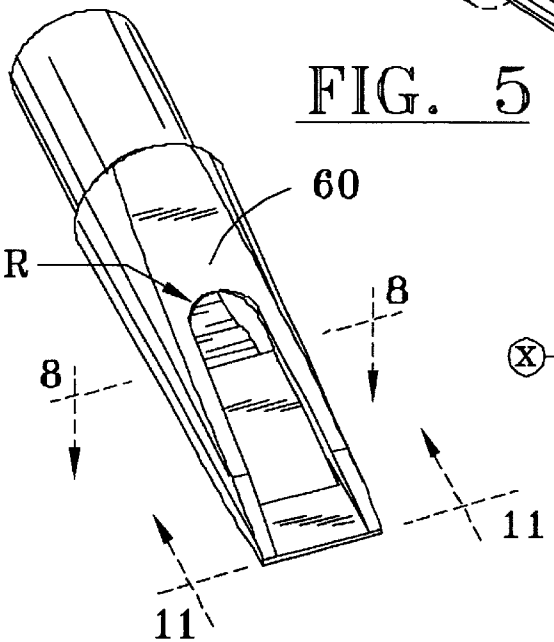
FIG. 7 is an isometric view of the reed side of the preferred embodiment of applicant's new mouthpiece.

In accordance with the present invention, we turn now to FIG. 5 which illustrates a new mouth piece design based on the Boehm harmonic theory, which stipulates that in order to achieve a brilliant and sonorous quality from a wind instrument it is necessary that the so molecules of the instrument be set in motion simultaneously with vibration of the air column in a manner so that they assist each other. To achieve this end we start with a redesign of the mouthpiece 50. As seen in FIGS. 5–8, the mouthpiece is configured externally, essentially the same as the prior art, with the mouthpiece 50 having a ligature assembly 52 for securing a primary reed (not shown) and a neck portion 54 for fitting into the musical instrument 56. As seen in FIG. 6, the mouthpiece 50 is somewhat longer than most mouthpieces and has a relatively small angle between the lower or reed side plane 60, seen in FIG. 7, and the upper or inclined lip wall 62 with a pronounced shoulder 64. In accordance with the Boehm theory, the mouthpiece is designed with a relatively thin wall thickness of 0.100 or less and made of a lightweight polymeric material to allow harmonic vibration. The walls of the mouthpiece 62 should be a consistent thickness, especially the upper lip or incline portion 62 as indicated by dimensions "η" in FIG. 8. The inclined portion 62 is at an included angle of less than 10 degrees off the central axis. Incline portion 62 intersects shoulder 64, forming a transition from the flattened surface 62 to the round tubular diametrical body of the mouthpiece. FIG. 8 further illustrates a longitudinal bore along axis ⓧ-ⓧ and a vertical centerline along axis ⊕-⊕. It is important to note that only the outermost tip 63 of the upper lip wall 62 is in contact with the longitudinal centerline "ⓧ-ⓧ" axis of the mouthpiece, unlike most other mouthpieces, as can be easily seen in FIG. 1–3. The transverse or vertical perpendicular centerline "ⓧ-ⓧ" seen in FIG. 8 serves as reed opening counterpoint for radius "R" seen in FIG. 7 and internal radius "R" for shoulder 64 with both radius being approximately the a same. The opening between the internal shoulder at corner 66 and the radius at the end of the reed opening is about equal, thereby placing a portion of the reed opening radius rearward of the center line ⊕-⊕ at distance "β" thereby allowing an abrupt expansion of air passing into the tone chamber 68 from between the reed plane and the upper lip wall 62. The area of the passage between the reed plane and the upper lip wall 62 is approximately two and one-half times smaller at cross section "A—A" than at cross section "B—B". Therefore, any further reduction in the area between the reed plane 60 and the upper lip wall 62, such as by the addition of a wedge block portion of the secondary reed types illustrated in FIGS. 9 and 10, further increases the velocity of air passing into the tone chamber 68. The relatively long reed surface plane coupled with the increased high velocity of air resulting from the drastically reduced area between the reed plane 60 and the upper lip wall 62 is allowed to expand abruptly into the tone chamber. The vibrations of the mouthpiece reed, multiplied by the high velocity, are transferred to the relatively thin walls of the mouthpiece. The walls being of a consistent thickness enable the molecules in the material to set up sympathetic harmonic resonance in the mouthpiece 50 along with the secondary reed, thereby adding increased overtones to the sounds produced by the instrument and dramatically improving the player's ability to play the instrument in the altissimo register by approximately 40% as derived by the average player's ability to play the altissimo register with a number 2 reed instead of a number five reed normally required by a much more accomplished player to play the altissimo register, thus making the instrument easier to play in the lower registers as well. The above described mouth piece 50, with its increased velocity and improved harmonics raises the range of the instrument by at least one octave while still allowing the instrument to be played softly by mouth suppression of the reed.

The secondary reed as disclosed by applicant in a previous patent described the secondary reed as simply an improved independent and interchangeable secondary reed having mounted thereon a wedge, the reed positioned inside the hollow mouthpiece chamber, the secondary reed vibrating sympathetically when the primary reed is placed in vibrating motion during ordinary use of the instrument to which the mouthpiece is attached and the wedge altering the cross-sectional area of the tone chamber of the mouthpiece and, whereby, the mouth piece vibrates in harmonic resonance with the both primary and sympathetic reeds. Applicant has since found that there is a good deal more involved here than first thought.

The teachings of the prior art suggest the use of a tone-enhancing member removably inserted into the mouthpiece. One such device used a step member with the steps facing outwardly, with no mention as to how this configuration enhances the tone of the instrument or to what magnitude. Applicant has determined that an elongated wedge shaped member effectively increases air velocity up to 40% and that a sudden expansion of air down stream of the wedge end improves resonance and by configuring the tone enhancing member in the shape of a peak a different tone is achieved. Therefore, by bonding the molded tone-enhancing member to a secondary or sympathetic reed, applicant has found that the abrupt drop off edge 70 of the wedge 70 as shown in FIG. 9 affects the secondary reed 74 in a materially different way than the peaked roof top member 76 shown in FIG. 10. Further the waveform of the secondary reeds 74, 78 provide a much smoother transition of air flowing over the tone enhancing members 72, 76. The reeds 74, 78 may also be provided with a wide range of material thickness to allow for tonal preferences. Interchangeability is therefore essential and is enhanced herein by simply making flexible members 72, 76 with their outer ends wider than the inner end, thereby allowing the secondary reeds to be retained in position by friction in most mouthpieces without special configuration or adaptation as shown in FIGS. 11 and 12. The reeds 74, 78 are bounded to the flexible members 72, 76, thereby allowing the secondary reeds 74, 78 to be independent and flexibly suspended in a non-restrained manner as is not the case with grooves illustrated in FIG. 2.

As further illustrated in FIGS. 13 and 14, the secondary reeds 69 and 75 illustrated in FIGS. 9 and 10 and their tone enhancing members 72, 76 are especially effective when the secondary reeds 69, 75 are wavy and the secondary reed is parallel positioned at or near the center line of the tone chamber 68. As seen in FIG. 13, where the secondary reed 75 is shown in place in the mouthpiece 50, air enters the mouthpiece at high velocity between the mouthpiece upper wall 62 and the primary reed 80. Air velocity multiplied by the front ramp portion of the tone-enhancing member 76 reaches maximum velocity as it passes between the peak 77 and the reed 80. The air is then allowed to expand gradually until it reaches the tone chamber 68 where it expands drastically and reduces velocity as it passes over and around the wavy surface of the secondary reed 78. Air passing through the tone chamber is thereby stabilized in a wave or sine pattern for entering the instrument. The sine wave 82 acts as a carrier wave for the vibrations induced into the airflow stream by the primary and secondary reeds 80, 78 as well as the vibration induced by the reeds 78,80 upon the relatively thin walls of the mouthpiece 50. As seen o in FIG. 14, when the secondary reed 69 is in placed in the mouthpiece 50, air enters the mouthpiece at high velocity between the mouthpiece upper wall 62 and the primary reed 80. The air velocity is multiplied by a gradual increasing ramp portion, of the tone enhancing member 72, reaching maximum velocity as it passes between the peak 81 and the reed 80. The air is then allowed to expand sharply until it reaches the tone chamber is 68, where it expands drastically and reduces velocity as it passes over and around the wavy surface of the secondary reed 78. Air passing through the tone chamber is thereby stabilized in a wave or sine pattern for entering the instrument, thereby serving as a carrier wave for harmonic vibrations imparted to it by the reeds 69, 80 and the mouthpiece itself. These changes in velocity and volume give the player a wide range of tones heretofore not available and, more importantly, achievable without any significant increase in effort by the player. The vibrating elements 50, 78,80 all act in concert to produce a clear and defined tone with increased velocity that allows the instrument to be driven beyond its normal design limit, thereby allowing the instrument to compete with much louder instruments.

The foregoing is considered as illustrative only of the principles of the invention. Further, since numerous modifications and changes will readily occur to those skilled in the art, it is not desired to limit the invention to the exact construction and operation shown and described, and, accordingly, all suitable modifications and equivalents may be resorted to, falling within the scope of the invention.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in any limiting sense.

What is claimed is:

1. A mouthpiece, one end of which is adapted to be engaged by the player's mouth and teeth and the other end of which is adapted to be installed in a woodwind musical instrument, the mouthpiece comprising:

a) a tubular body having an elongated shape extending along a central axis, the tubular body having a uniform wall thickness of less than 0.100 in., a portion of the rearward end of the tubular body having a slightly thinner wall to allow an external portion thereof to be inserted into a wind instrument;

b) a generally flattened, inclined upper wall surface located at the forward end of said tubular body, said upper wall surface adapted to be engaged by the mouth and teeth of a player, the inclined upper wall surface extending from a point on said central to a shoulder transitioning the inclined upper wall surface and the outer diameter of the tubular body forming a tone chamber therein; and c) a plainer surface having a slight arc therein extending from said central axis at point of contact with said flattened, inclined upper wall surface and extending rearward at an acute angle relative to said central axis, said plainer surface adapted for supporting a primary reed on the mouthpiece across an open portion of said air passageway below said central axis adjacent the upper wall surface portion of the mouthpiece, said plainer surface forming an elongated opening in said tubular member culminating in a radius, the center point of which is rearward of said shoulder.

2. The mouthpiece according to claim 1 wherein the mouthpiece comprises a transverse centerline passing through said radius center point perpendicular to said central axis, the intersection of said centerline and said central axis being the center for an internal radius tangent to said shoulder and upper inner wall of said tubular body.

3. The mouthpiece according to claim 1 wherein walls of said mouthpiece vibrate in sympathetic harmonic resonance when stimulated by a reed.

4. The mouthpiece according to claim 2 wherein said plainer surface radius and said internal radius are equal.

5. The mouthpiece according to claim 1 wherein said inclined upper wall surface is positioned at an included angle of less than ten degrees above the central axis.

6. A sympathetic reed having a wave formed therein and a wedge shaped resilient tone enhancing member secured to one end of said reed opposite said wave form, the tone member having a thick end and a thin end, the thin end being wider than the thick end.

7. A sympathetic reed having a wave formed therein and a peaked roof top shaped resilient tone enhancing member secured to one end of said reed opposite said wave form, the tone member being wider at one end.

8. The mouthpiece according to claim 3 wherein said mouthpiece further comprises a secondary reed having a wave formed therein and a resilient tone enhancing member adhered thereto, the reed removably swaged within said mouthpiece in a manner wherein said reed is in contact with said upper incline wall, the wavy portion of the reed extending into said tone chamber beyond said shoulder and along said central axis.

9. The mouthpiece according to claim 8 wherein said tone enhancing member is used to swage said reed into said mouthpiece.

10. The mouthpiece according to claim 3 wherein said mouthpiece improves player production of the altissimo register by up to 40%.

11. The mouthpiece according to claim 8 wherein said secondary reed vibrates in sympathetic resonance with said primary reed and said mouthpiece.

12. The mouthpiece according to claim 11 wherein said secondary reed having a wave formed therein establishes a sine wave of air flowing through the mouthpiece along said central axis.

13. The mouthpiece according to claim 12 wherein air entering said mouth piece between said upper incline wall and said primary reed gradually increases in velocity as it passes over said tone enhancing member and is then allowed to expand abruptly, reacting on said secondary reed thereby setting it in motion.

14. The mouthpiece according to claim 12 wherein air entering said mouth piece between said upper incline wall and said primary reed gradually increases velocity as it passes over said tone enhancing member and then gradually decreases prior to reacting on said secondary reed and thereby setting it in motion.

15. The mouthpiece according to claim 12 wherein vibrations generated by said primary reed, secondary reed and said mouthpiece are imposed on said sine wave and are carried along the air column through a musical instrument attached to said mouthpiece.

16. The mouthpiece according to claim 8 wherein tones produced by said tone enhancing member and said primary reed are controlled by pressure exerted on said primary reed by a player's teeth and lips.

* * * * *